US005207167A

United States Patent [19]

Inomata

[11] Patent Number: 5,207,167

[45] Date of Patent: May 4, 1993

[54] COOLING AND WASTE COLLECTION SYSTEM FOR A SEWING MACHINE

[75] Inventor: Katsuyoshi Inomata, Chofu, Japan

[73] Assignee: Juki Corporation, Tokyo, Japan

[21] Appl. No.: 691,343

[22] Filed: Apr. 25, 1991

[30] Foreign Application Priority Data

Apr. 25, 1990 [JP] Japan ..... 2-44313[U]
Sep. 25, 1990 [JP] Japan ..... 2-100058[U]

[51] Int. Cl.[5] ..... D05B 71/00; D05B 81/00; F28F 13/12

[52] U.S. Cl. ..... 112/280; 112/282; 165/123

[58] Field of Search ..... 112/DIG. 1, 287, 288, 112/197, 256, 220, 280, 281, 282, 259; 15/347, 348, 352, 313, 339; 165/123, 916

[56] References Cited

U.S. PATENT DOCUMENTS

| | | | |
|---|---|---|---|
| Re. 30,907 | 4/1982 | Gauch et al. | 112/280 |
| 2,082,738 | 6/1937 | Vesconte | 112/282 X |
| 2,447,115 | 8/1948 | Christensen | 112/280 X |
| 2,827,867 | 3/1958 | Happe | 112/282 X |
| 3,771,478 | 11/1973 | Tranquilla et al. | 112/280 |
| 3,779,188 | 12/1973 | Marforio | 112/280 |
| 4,145,985 | 3/1979 | Klundt | 112/280 |
| 4,154,182 | 5/1979 | Klundt | 112/280 |
| 4,393,801 | 7/1983 | Kato et al. | 112/282 |

FOREIGN PATENT DOCUMENTS

| | | | |
|---|---|---|---|
| 59-11749 | 4/1984 | Japan . | |
| 2087443 | 5/1982 | United Kingdom | 112/282 |

*Primary Examiner*—Clifford D. Crowder
*Assistant Examiner*—Paul C. Lewis
*Attorney, Agent, or Firm*—Morgan & Finnegan

[57] ABSTRACT

A cooling and waste collection system for a sewing machine which includes a fan connected to a main shaft of the sewing machine, and an air passage having a suction passage and a cooling passage, where the suction passage feeds in air from the outside atmosphere to an air blowing chamber. The cooling passage feeds air from the air blowing chamber to an oil pan of the sewing machine. The suction passage has one end connected to the air blowing chamber and another end opening at the work area of the sewing machine. The cooling system further comprises a waste collection system positioned in the air passage for accumulating waste materials generated when sewing.

12 Claims, 6 Drawing Sheets

COOLING AND WASTE COLLECTION SYSTEM FOR A SEWING MACHINE

FIELD OF THE INVENTION

The present invention relates to a sewing machine, and more particularly to cooling systems and waste collection systems for sewing machines.

BACKGROUND OF THE PRESENT INVENTION

Sewing machines typically generate heat and must be cooled for continued operation. Maintaining an adequate air circulation is an effective way to prevent overheating. Conventional sewing machines have thus employed various cooling devices, such as a fan, to direct a cooling flow of air to an oil plan to prevent overheating.

Another problem, seemingly unrelated, in sewing machines is that loose threads and cloth pieces may interfere with the sewing operation and damage the sewing machine. Thus, conventional sewing machines have employed various devices, such as suction devices, to remove waste materials from the work area, and gather them into a waste housing or collector.

Although a sewing machine may incorporate both functions, two motors are conventionally required: one to drive the sewing machine and its cooling fan, and the other to drive a waste suction device within the sewing machine. Such sewing machines having both motorized functions are bulky, complicated, and expensive.

It is therefore an object of the present invention to provide a sewing machine having improved cooling and waste collection systems which are less expensive, more efficient, and more economical than convential types of systems.

SUMMARY OF THE INVENTION

To accomplish these and other objects of the invention, a sewing machine is provided which includes a fan for cooling an oil pan unit which fan also serves as a suction generating mechanism for removing waste to a waste collector.

In preferred embodiments, the invention may include an air blowing chamber in which a fan is so disposed as to rotate in association with a main shaft. A cooling passage is provided in the form of a trough, which is open so as to communicate with the air blowing chamber and the oil pan unit. Also provided is a suction port for taking air into the blowing chamber through an air guide pipe, one end of which is connected to a suction port and the other end open. This open end is adjacent to a working area of the sewing machine so that waste fabric parts and threads generated during the sewing operation can be suctioned away. These wastes are then collected by a waste collecting mechanism which includes an air guide plate, a filter, and a waste receptacle.

In addition, a cooling and waste collecting system for a sewing machine according to the invention may be arranged such that the suction pipe is directly connected to the suction port, and such that the waste collecting mechanism is provided in an opening in the cooling passage on the bottom of the oil pan.

Further, a cooling and waste collecting system for a sewing machine, according to another embodiment of the invention, further includes a mechanism for transmitting rotation from the main shaft of the sewing machine to another shaft for driving the fan, said transmission mechanism having a variable transmission ratio.

In a further embodiment of the invention, the rotation of the sewing machine fan generates a negative pressure which draws in waste threads and the like left around the periphery of upper and lower cutting knifes through the suction pipe and collects the waste threads and the like in the waste collecting mechanism. The air with all the wastes removed is then guided by the fan to the air blowing chamber and then flows into the bottom of the oil pan.

The waste threads and the like drawn from the suction pipe may be collected by the fan of the waste collecting mechanism on the bottom of the oil pan.

In another embodiment, a mechanism may be provided to transmit rotation from the main shaft to the fan at a variable transmission ratio, with the prescribed rotation speed of the fan being independent of the rotation speed of the sewing machine.

BRIEF DESCRIPTION OF THE DRAWINGS

The invention will be described in greater detail below with reference to the attached drawings, in which.

DETAILED DESCRIPTION OF THE INVENTION

Figure 1:
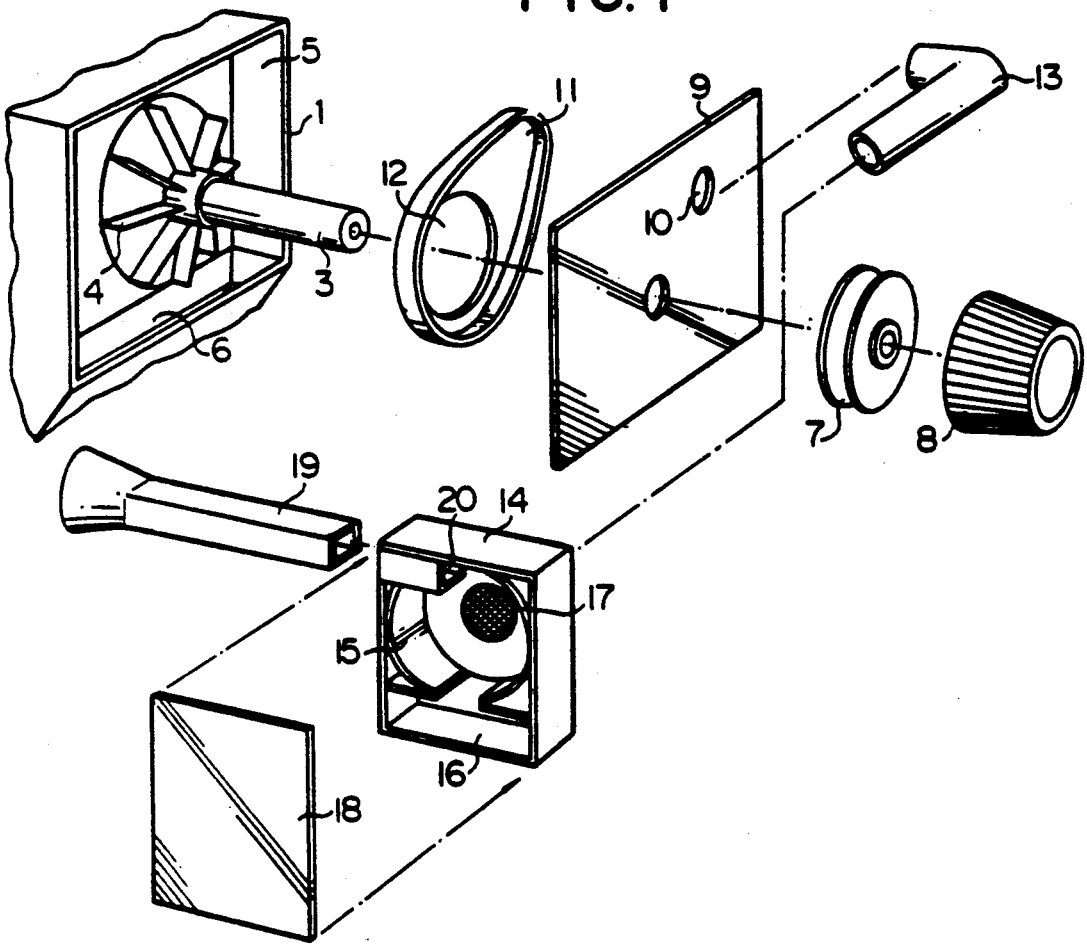
FIG. 1 is an exploded perspective view of a portion of a cooling and waste collection system for a sewing machine according to a first embodiment of the present invention.
Figure 2:
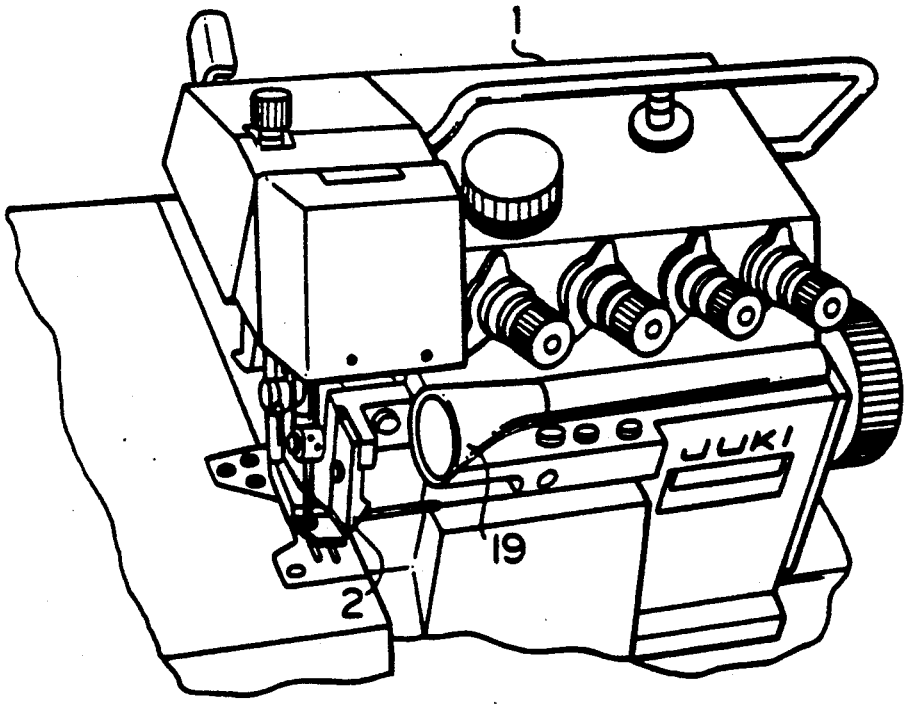
FIG. 2 is an overall perspective view of the present invention.
Figure 3:
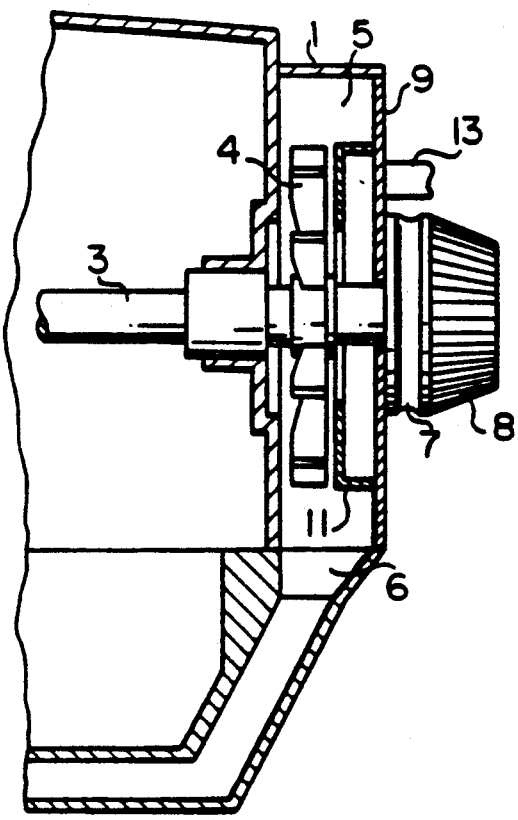
FIG. 3 is a sectional and partly broken away view showing the apparatus as shown in FIG. 1.

A first embodiment of the invention will be explained hereinafter. FIGS. 1, 2, and 3 show a frame 1 of a sewing machine body, in which as shown in FIG. 2 waste threads, cloth chips and the like, which frequently remain in the sewing work area, are cut by trimming and cutting knives 2. FIG. 1 further shows a main shaft 3 of the sewing machine and a fan 4 journaled to the shaft 3 to generate an air flow.

An air blowing chamber 5 allows fan 4 to rotate and generate an air flow, and chamber 5 is open toward the forward end of main shaft 3. Preferably, blowing chamber 5 is so fabricated as to form the upper corners of the frame in a circular form. A cooling passage 6 has one end open to the under side of blowing chamber 5 and the other end open opposite to an oil pan (not shown) disposed on the bottom of the sewing machine body.

A pulley 7 is adapted for transmitting the rotation of a sewing machine driving motor by a belt (not shown) to the main shaft of the sewing machine. A knob 8 is adapted for actuating a sewing machine needle by the operator separate from the drive of the motor.

A partition 9 serves to close the open side of air blowing chamber 5 and guides a flow of air from the outside through a suction port 10 which is formed in partition 9. An air guide cover 11 guides the flow of the suctioned air to the rotating blades of the fan 4. The air guide cover 11 is disposed opposite to the fan 4 and covers suction port 10, thereby defining a space between the cover and the air guide plate 9 which guides the flow of the suctioned air. The air guide cover 11 has an opening 12 having a diameter larger than that of the main shaft 3 but smaller than the circumference of the fan 4.

An L-shaped air guide pipe 13 has one end inserted into suction port 10 and the other end fitted into a waste housing or collector 14. The waste housing or collector 14 consists of an air guide plate 15 which is circular and having a notch at the base thereof, and a waste receptacle 16 adapted to receive waste threads through the notch. A filter 17 is between the waste collector 14 and the L-shaped air guide pipe 13. A lid 18 covers waste collection housing 14. A suction pipe 19 has one end inserted into a hole 20 which is bored through the upper end of the circular air guide plate 15 of the waste collector 14. The other end of the suction pipe 19 is situated in close proximity to the trimming knife 2, which is adjacent to the article to be sewn by the sewing machine.

The operation of the above apparatus, the first embodiment described herein, will be apparent from the following description.

When the sewing machine is initially actuated, the main shaft 3 of the sewing machine rotates fan 4. This generates a flow of air which moves from the blowing chamber 5 through cooling passage 6 to an oil pan. This flow of air from chamber 5 through cooling passage 6 creates a negative pressure in the space between partition 9 and air guide cover 11, thus generating a flow of air through air guide pipe 13, the waste collector 14, and the suction pipe 19, thereby providing suction power in the suction port at the forward end of suction pipe 19. When the sewing machine sews, the waste threads, cloth clips and other pieces that are left adjacent to the trimming knife 2 are drawn into the intake port of suction pipe 19 by the suction created by the rotating fan 4, and the waste pieces then flow out of pipe 19 and into Waste collector 14. Upon entry into the waste collector 14, the waste threads and the like circulate along the inside of circular air guide plate 15, and then by their own weight drop into waste receptacle 16 and are accommodated therein. Tiny waste threads and the like which fail to drop in waste receptacle 16 are caught by filter 17, and thus prevented from entering air guide pipe 13.

The suctioned air passes through air guide pipe 13, which is attached to the center of the circular air guide plate 15, through suction port 10 formed in partition 9, and then through the air guide cover 11 to the blowing chamber 5 in which the fan 4 rotates.

Although suction pipe 19 in the first embodiment is connected by the waste collector 14 to the air guide pipe 13, suction pipe 19 may be directly connected to the air guide pipe 13, and the waste collector 14 may be provided in an open side of the cooling passage 6.

The instant apparatus according to the second embodiment of the invention will be detailed with reference to FIGS. 4 and 5 wherein like reference numerals designate like or corresponding parts used in FIGS. 1, 2, and 3. Thus, a detailed description of similar parts will not be repeated.

Figure 4:
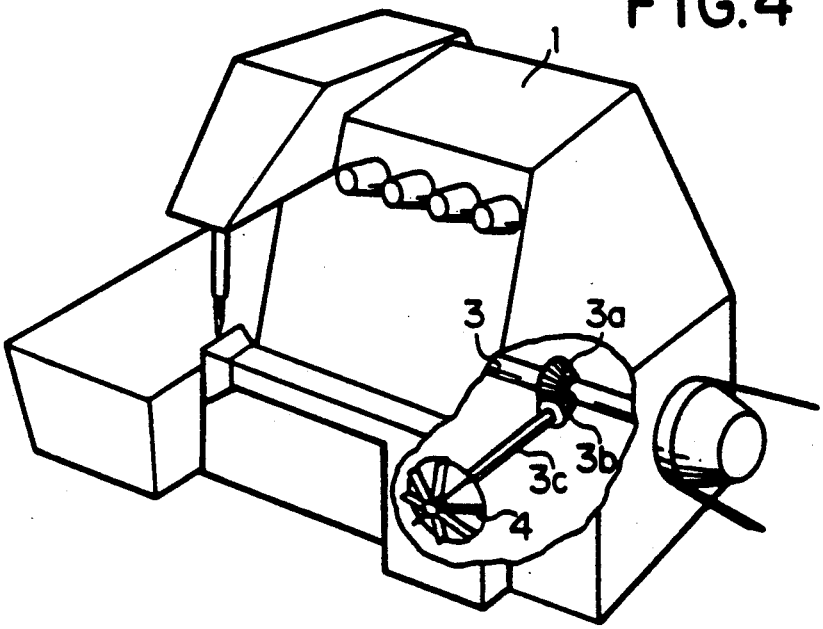
FIG. 4 is a perspective and partly broken away view of the present invention according to a second embodiment of the invention.
Figure 5:
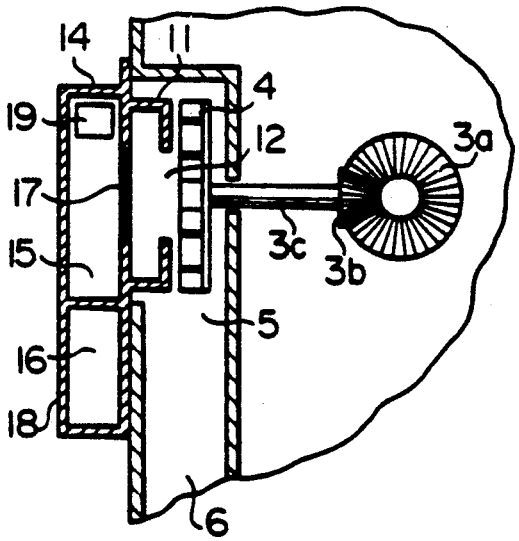
FIG. 5 is a sectional view of the present invention according to the second embodiment.

In FIGS. 4 and 5, show a frame 1 of the sewing machine body and a main shaft 3 thereof. A first bevel gear **3*a* is mounted on the main shaft 3 of the sewing machine. A second bevel gear 3*b* is mounted on a shaft 3*c*. Second bevel gear 3*b* meshes with the first bevel gear 3*a* and transmits a rotating driving force perpendicular to main shaft 3. Shaft 3*c* is adapted to transmit the perpendicular driving force to fan 4. Air blowing chamber 5 is within a panel disposed in front of the sewing machine body, and is provided with a hole through which shaft 3*c* passes and a space in which fan 4 may rotate. Air guide cover 11 has an intake opening diameter greater than that of rotary shaft 3*c* but smaller than the circumference of fan 4. FIG. 5 also shows a waste housing or collector 14, a circular air guide plate 15, a waste receptacle 16, a filter 17, a lid 18, and a suction pipe 19**.

Operation of the instant apparatus in the second embodiment arranged as aforementioned will be readily understood from the following description. When operating, the sewing machine rotates main shaft 3, which turns bevel gear **3*a* which is journaled to main shaft 3, which turns bevel gear 3*b* which is meshed therewith, which rotates shaft 3*c*, which turns fan 4. This fan movement creates a negative pressure in air guide cover 11 which then draws air from intake opening 12, which draws air from waste housing 14, which draws air from suction pipe 19. Waste threads and the like generated through operation of the sewing machine are then drawn into suction pipe 19, and are then collected in waste collector 14. Only air, however, passes through filter 17 into air guide cover 11, through intake opening 12 and into the fan 4. The filtered air then passes cooling passage 6** to an oil pan of the sewing machine.

In the aforementioned second embodiment, the rotation of main shaft 3 is imparted by a first and second bevel gears **3*a* and 3*b* to fan 4**. In this connection, it is noted that as long as the transmission ratio of the first bevel gear to the second is 2:1, the suction force required for waste collection may be obtained even if the sewing machine is driven at one-half the normal rotating speed. Nonetheless, the transmission ratio of the gears is not limited to 2:1, but may be set in any desired ratio.

Although the first and second embodiments describe the waste intake inlet, which is in the proximity of the trimming knife 2 of the sewing machine, it may be, of course, in the proximity of the shaft of the looper.

The first and second embodiments illustrate a waste housing or collector 14 which fits over the L-shaped air guide pipe 13, and is composed of the air guide plate 15, receptacle 16 and filter 17, which is only provided in the hollow waste housing or collector 14 to shut out the waste threads and the like.

Figure 6:
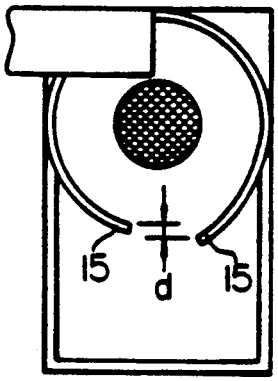
FIG. 6 is a sectional view of a modified waste housing or collector as described in the present invention.
Figure 7:
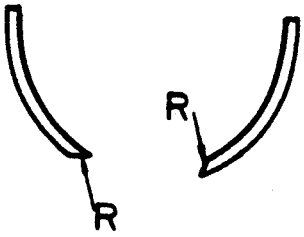
FIG. 7 is a view showing a portion of a modified circular air guide plate.

Referring now to FIG. 6, the opposite ends of circular air guide plate 15 are slightly offset. In particular, the right end of air guide plate 15 is offset downwardly and out of alignment with the left end, providing a gap d to obtain a better waste collection effect. This same effect may also be obtained by rounding the inward side of the right end of air guide 15 and the outward side of the left end of air guide 15, as shown in FIG. 7.

Figure 8:
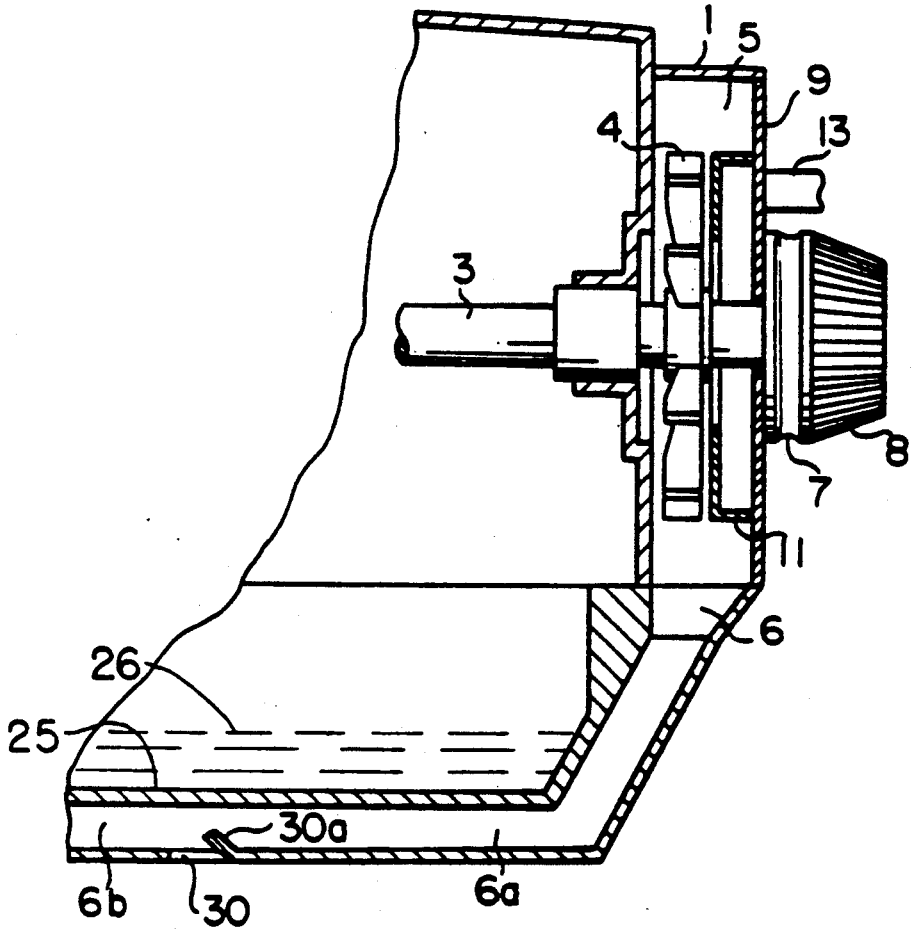
FIG. 8 is a sectional and partly broken away view showing a modified cooling passage of the present invention.

FIG. 8 illustrates a modification of cooling passage 6, described in the first embodiment. The reference numerals in FIG. 8 designate like or corresponding parts used in FIG. 1 and to which the instant apparatus is similar, except that cooling passage 6 has an air intake port 30 and a lug or projection 30*a*.

Air intake port 30 is formed at the bottom of cooling passage 6 under oil pan 25 which contains oil 26. Lug or projection 30*a* lies upstream of port 30, and narrows the path 6*a* of the air flow thereto. Thus, lug or projection 30*a* restricts the air flow down cooling passage 6, resulting in increased velocity of the flow from the air blowing chamber 5. Cooling passage 6, however, is widened downstream of the air intake port 30. This widening results in a decrease in air pressure within the widened path 6*b*, thereby admitting outside air to enter at air intake port 30 and mix with the air from air blowing chamber 5. For this reason, air delivered from air blowing chamber 5 which has been heated by the heat generated by the sewing machine body is effectively cooled by the incoming air from port 30, thereby preventing the oil in the oil pan from heating.

Figure 9:
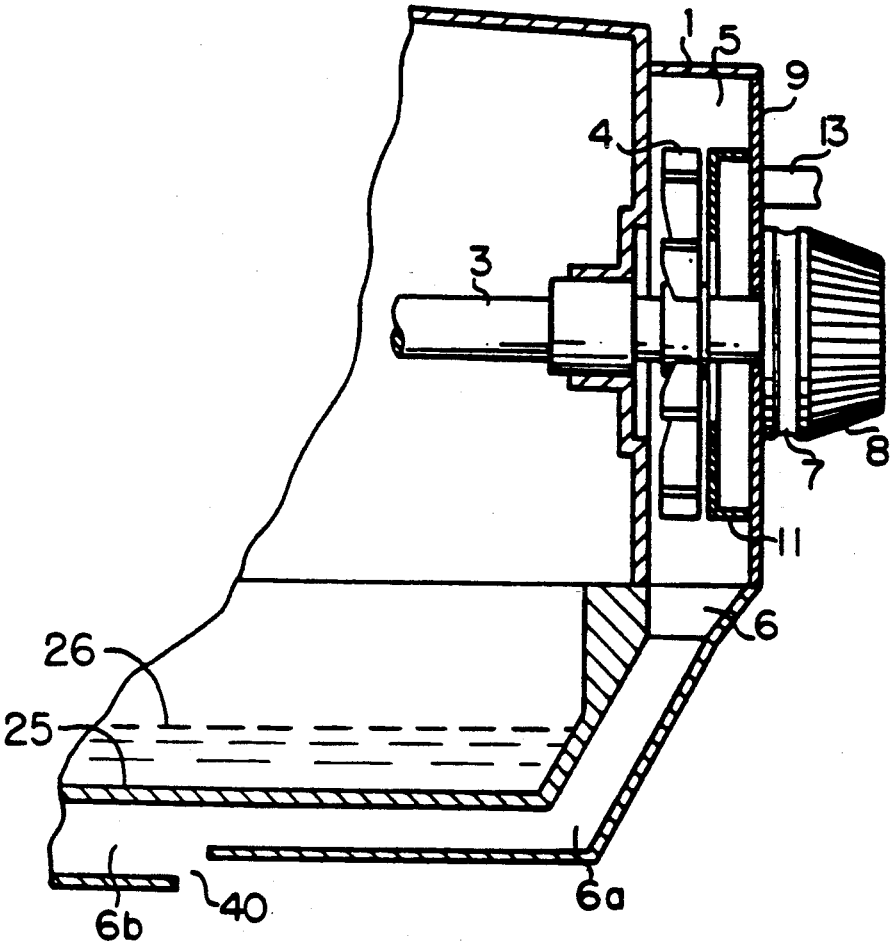
FIG. 9 is a sectional and partly broken away view showing another modified cooling passage.

Another modification of cooling passage 6 is shown in FIG. 9, wherein an air intake port 40 widens the down stream or wide path 6*b* to decrease the pressure of the air passing through air intake 40, and also admit therein more air from the outside.

Cooling passage 6, as shown in FIGS. 8 and 9 employing the modifications described herein, is capable of improving the cooling effect without requiring a large sized fan 4. Lastly, cooling passage 6, as illustrated in FIGS. 8 and 9, may also be applied to the second embodiment, shown in FIGS. 4 and 5.

Thus, although the invention has been described in detail above by way of reference to the drawings and the preferred embodiments, it should be understood that the invention is not limited to the embodiments herein described, but should be interpreted in accordance with the claims that follow.

I claim:

1. A cooling system for a sewing machine comprising:

a fan rotatably driven by a main shaft of the sewing machine;

an air blowing chamber partially enclosing said fan;

an air passage having a suction passage for feeding air from the outside atmosphere to said air blowing chamber and a cooling passage for feeding air from said air blowing chamber to an oil pan of the sewing machine, said suction passage having one end connected to said air blowing chamber and another end opening at the sewing area of the sewing machine, and said cooling passage having one end connected to said air blowing chamber and another end connected to said oil pan;

an air intake port mounted within said cooling passage; and pressure decreasing means mounted within the cooling passage for lowering the air pressure at said air intake port and to draw air through said air intake port.

2. A cooling system for a sewing machine as claimed in claim 1, wherein said cooling passage has an upstream and a downstream side, and wherein said pressure decreasing means comprises a projection mounted within said cooling passage upstream of said air intake port.

3. A cooling system for a sewing machine as claimed in claim 1, wherein said cooling passage has a upstream and a downstream side, and wherein said pressure decreasing means comprises a narrow path mounted within said cooling passage upstream of said air intake port and a widened path mounted within said cooling passage downstream of said air intake port.

4. A cooling and waste collection system for a sewing machine, comprising:

a fan rotatably drive by a main shaft of the sewing machine;

an air blowing chamber partially enclosing said fan;

an air passage having a suction passage for feeding air from the outside atmosphere to said air blowing chamber and a cooling passage for feeding air from said air blowing chamber to an oil pan of the sewing machine, said suction passage having one end connected to said air blowing chamber and another end opening at the sewing area of the sewing machine, and said cooling passage having one end connected to said air blowing chamber and another end connected to said oil pan;

waste collection means mounted within said air passage; and a suction power means positioned between the air blowing chamber and the suction passage for generating suction forces by the rotation of the fan.

5. A cooling and waste collection system for a sewing machine, comprising:

a fan rotatably driven by a main shaft of the sewing machine;

an air blowing chamber partially enclosing said fan;

an air passage having a suction passage for feeding air from the outside atmosphere to said air blowing chamber and a cooling passage for feeding air from said air blowing chamber to an oil pan of the sewing machine, said suction passage having one end connected to said air blowing chamber and another end opening at the sewing area of the sewing machine, and said cooling passage having one end connected to said air blowing chamber and another end connected to said oil pan;

waste collection means mounted within said air passage;

a transmission means provided between said main shaft and said fan for transmitting rotation of said main shaft to said fan so that said fan rotates more quickly than said main shaft.

6. A cooling and waste collection system for a sewing machine as claimed in claim 5, wherein said transmission means comprises a first gear fixed to said main shaft and a fan assembly having a shaft connected to said fan and a second gear connected to said fan assembly shaft, said second gear being engaged with said first gear, and where said fan assembly is changeable.

7. A cooling and waste collection system for a sewing machine, comprising:

a fan rotatably driven by a main shaft of the sewing machine;

an air blowing chamber partially enclosing said fan;

an air passage having a suction passage for feeding air from the outside atmosphere to said air blowing chamber and a cooling passage for feeding air from said air blowing chamber to an oil pan of the sewing machine, said suction passage having one end connected to said air blowing chamber and another end opening at the sewing area of the sewing machine, and said cooling passage having one end connected to said air blowing chamber and another end connected to said oil pan;

waste collection means mounted within said air passage further comprising a housing and a filter, wherein said housing is connected to said suction passage;

a waste receptacle positioned under said housing for receiving waste; and an air guide plate positioned between said filter and waste receptacle, said air guide plate having a lower part opening downward.

8. A cooling and waste collection system for a sewing machine as claimed in claim 7, wherein said lower part of said air guide plate has an upstream end and a downstream end opposing each other, wherein said upstream end is positioned higher than said downstream end.

9. A cooling and waste collection system for a sewing machine as claimed in claim 7, wherein said air guide plate has an upstream end and a downstream end opposing each other, said upstream end having a rounded upper portion and said downstream end having a rounded lower portion.

10. A cooling and waste collection system for a sewing machine, comprising:

a fan rotatably driven by a main shaft of the sewing machine;

an air blowing chamber partially enclosing said fan;

an air passage having a suction passage for feeding air from the outside atmosphere to said air blowing chamber and a cooling passage for feeding air from said air blowing chamber to an oil pan of the sewing machine, said suction passage having one end connected to said air blowing chamber and another end opening at the sewing area of the sewing machine, and said cooling passage having one end connected to said air blowing chamber and another end connected to said oil pan; and waste collection means mounted within said air passage;

wherein said cooling passage includes an air intake port and suction power means for lowering air pressure at said air intake port to draw air through said air intake port.

11. A cooling and waste collection system for a sewing machine as claimed in claim 10, wherein said suction power means comprises a projection mounted on the upstream side of said air intake port.

12. A cooling and waste collection system for a sewing machine as claimed in claim 10, wherein said suction power means comprises a narrow path positioned on the upstream side of said air intake port and a widened path positioned on the downstream side of said air intake port.

* * * * *